US012252372B2

(12) United States Patent
Tamura

(10) Patent No.: US 12,252,372 B2
(45) Date of Patent: Mar. 18, 2025

(54) MEDIUM TRANSPORT APPARATUS

(71) Applicant: SEIKO EPSON CORPORATION, Tokyo (JP)

(72) Inventor: Yosaku Tamura, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 247 days.

(21) Appl. No.: 17/645,123

(22) Filed: Dec. 20, 2021

(65) Prior Publication Data

US 2022/0194725 A1 Jun. 23, 2022

(30) Foreign Application Priority Data

Dec. 23, 2020 (JP) ..... 2020-214136

(51) Int. Cl.
*B65H 5/06* (2006.01)

(52) U.S. Cl.
CPC ..... *B65H 5/062* (2013.01); *B65H 2402/45* (2013.01); *B65H 2404/142* (2013.01)

(58) Field of Classification Search
CPC ..... B65H 5/062; B65H 2402/45; B65H 2404/142
See application file for complete search history.

(56) References Cited

U.S. PATENT DOCUMENTS 5,163,674 A * 11/1992 Parks ..... B41J 13/076 271/274
6,829,453 B2 * 12/2004 Kouzu ..... G03G 21/1638 399/124
6,993,268 B2 1/2006 Otaka
7,317,887 B2 1/2008 Otaka
10,040,658 B2 8/2018 Maeda
10,526,153 B2 1/2020 Maeda
2004/0175210 A1 9/2004 Otaka
2006/0083547 A1 4/2006 Otaka
2007/0031165 A1 2/2007 Lee et al.
2011/0188885 A1 8/2011 Fukunaga
(Continued)

FOREIGN PATENT DOCUMENTS

CN 1542560 11/2004
JP 59-207364 * 11/1984
(Continued)

OTHER PUBLICATIONS

Machine translation of JP59-207364. (Year: 1984).*
Machine translation of JP4-7240. (Year: 1992).*
Machine translation of JP2010-262188. (Year: 2010).*

*Primary Examiner* — Thomas A Morrison
(74) *Attorney, Agent, or Firm* — WORKMAN NYDEGGER

(57) ABSTRACT

A transport section includes a first roller, a second roller, a first rotating shaft, a second rotating shaft, a support unit, a main body, a door, and a third rotating shaft. The second roller nips a paper sheet together with the first roller. The first rotating shaft rotatably supports the first roller; the second rotating shaft rotatably supports the second roller. The support unit supports the first rotating shaft; the main body supports the support unit. The third rotating shaft allows the door to rotate. When the door is opened, the support unit moves the first rotating shaft to an escaped point. The escaped point of the first rotating shaft is further from the first roller positioned at the nip point than the nip point.

11 Claims, 14 Drawing Sheets

(56) References Cited

U.S. PATENT DOCUMENTS

| | | | | |
|---|---|---|---|---|
| 2013/0241146 | A1* | 9/2013 | Takai | G03G 15/6567 271/273 |
| 2017/0282603 | A1 | 10/2017 | Maeda | |
| 2018/0327207 | A1 | 11/2018 | Maeda | |

FOREIGN PATENT DOCUMENTS

| | | | |
|---|---|---|---|
| JP | 4-7240 | * | 1/1992 |
| JP | 2004-269151 A | | 9/2004 |
| JP | 2010-262188 | * | 11/2010 |
| JP | 2016-185836 | | 10/2016 |
| JP | 2017-186114 | | 10/2017 |

* cited by examiner

MEDIUM TRANSPORT APPARATUS

The present application is based on, and claims priority from JP Application Serial Number 2020-214136, filed Dec. 23, 2020, the disclosure of which is hereby incorporated by reference herein in its entirety.

BACKGROUND

1. Technical Field

The present disclosure relates to medium transport apparatuses.

2. Related Art

JP-A-2004-269151 discloses an example of a sheet transport apparatus, which includes: a main body; a door attached to the main body; a transport roller pair; and a lock mechanism that operates in response to the opening of the door. Further, the transport roller pair includes: a first roller supported on the door; and a second roller supported inside the main body. When a user attempts to open the door, the lock mechanism releases the contact between the first and second rollers so that the first roller can move apart from the second roller.

Sheet transport apparatuses, as described above, disadvantageously have heavy, complicated door mechanisms, in which a member that supports a first roller on a door moves together with the door. Thus, some users may have trouble opening or closing the door.

SUMMARY

According to an aspect of the present disclosure, a medium transport apparatus includes: a first roller that transports a medium; and a second roller that nips the medium together with the first roller. A first rotating shaft rotatably supports the first roller; a second rotating shaft rotatably supports the second roller. A support mechanism supports the first rotating shaft; a main body supports the support mechanism. A door to be opened or closed is on the main body. A third rotating shaft allows the door to be rotated between a closed location and an open location, the third rotating shaft extending along a direction intersecting the first rotating shaft, the closed location being a location of the door closed, the open location being a location of the door open. When the door is rotated from the closed location to the open location, the support mechanism moves the first rotating shaft from a nip position at which the first roller and the second roller nip the medium and a escaped position at which the first roller escapes from the second roller, the escaped point being further from the first roller positioned at the nip point than the nip point.

DESCRIPTION OF EXEMPLARY EMBODIMENTS

Figure 1:
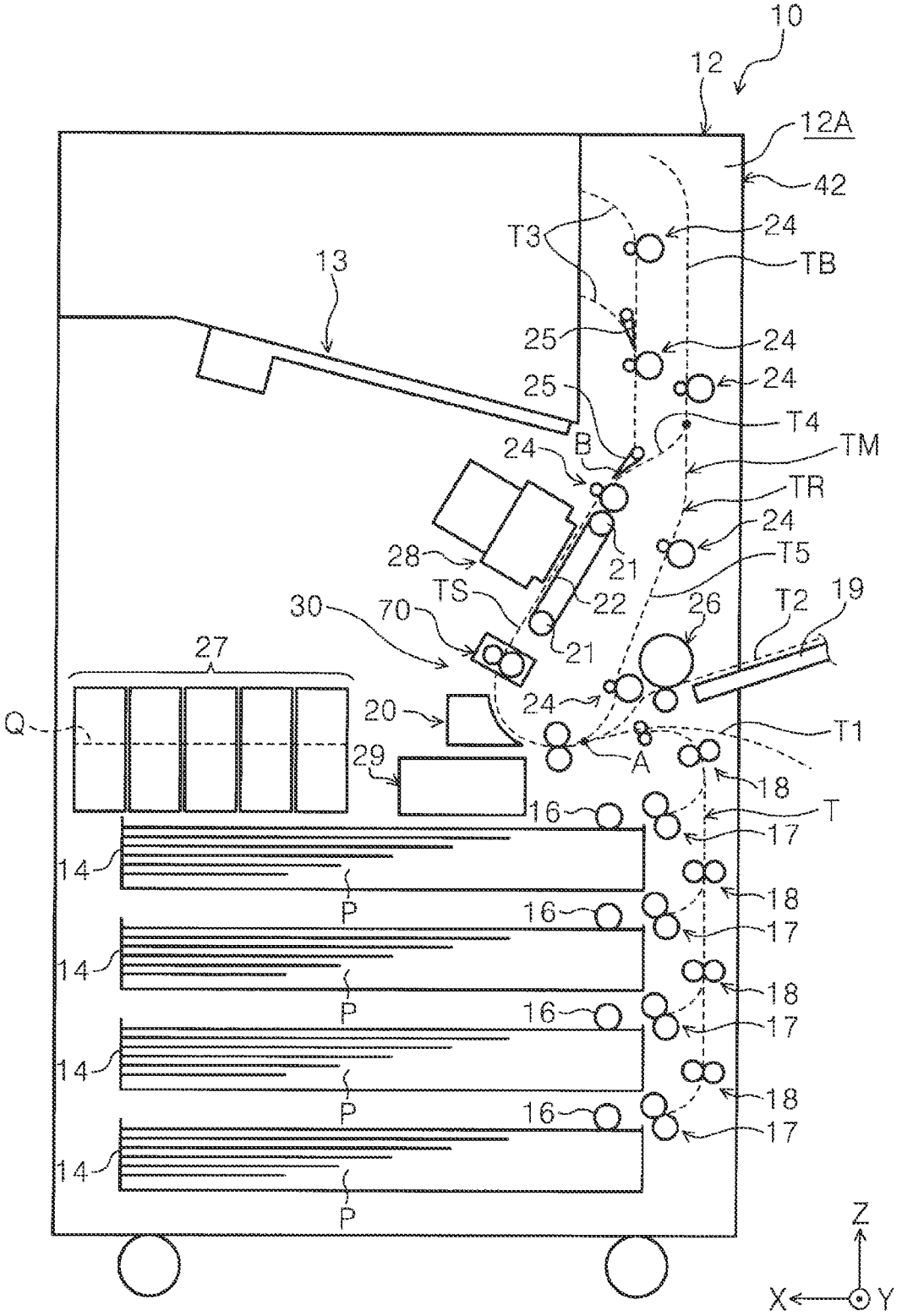
FIG. 1 is a schematic view of an overall configuration of a printer according to an embodiment of the present disclosure.

Some aspects of the present disclosure will be described below briefly. According to a first aspect of the present disclosure, a medium transport apparatus includes: a first roller that transports a medium; and a second roller that nips the medium together with the first roller. A first rotating shaft rotatably supports the first roller; a second rotating shaft rotatably supports the second roller. A support mechanism supports the first rotating shaft; a main body supports the support mechanism. A door to be opened or closed is on the main body. A third rotating shaft allows the door to be rotated between a closed location and an open location, the third rotating shaft extending along a direction intersecting the first rotating shaft, the closed location being a location of the door closed, the open location being a location of the door open. When the door is rotated from the closed location to the open location, the support mechanism moves the first rotating shaft from a nip position at which the first roller and the second roller nip the medium and a escaped position at which the first roller escapes from the second roller. The escaped point being further from the first roller positioned at the nip point than the nip point.

With regard to the first aspect, when a user opens the door by rotating the door around the third rotating shaft, the support mechanism may move the first rotating shaft from the nip point to the escaped point, thereby releasing a nipping state of the first and second rollers. Since the support mechanism that releases the nipping state may be disposed in the main body, the door can be implemented with a simple, lightweight mechanism.

According to a second aspect of the present disclosure, the medium transport apparatus may have, in addition to the configuration of the first aspect, a configuration in which the support mechanism includes a first contact section, a first moving section, a second contact section, and a second moving section. The first contact section may be configured to make contact with the door at a first end in an axial direction along the first rotating shaft. The first moving section may move a first end of the first rotating shaft by receiving a force generated by contact between the first contact section and the door. The second contact section may be configured to make contact with the door at a second end of the first rotating shaft in the axial direction. The second moving section may move the second end of the first rotating shaft by receiving a force generated by contact between the second contact section and the door.

With regard to the second aspect, both the first moving section and the first contact section may be disposed at the first end in the axial direction along the first rotating shaft. In addition, both the second moving section and the second contact section may be disposed at the second end in the axial direction along the first rotating shaft. However, no mechanisms for moving the first rotating shaft may be disposed at the center of the first rotating shaft in the axial direction. Thus, it is possible to dispose other functional components around the center of the first rotating shaft.

According to a third aspect of the present disclosure, the medium transport apparatus may have, in addition to the configuration of the second aspect, a configuration in which the third rotating shaft is positioned adjacent to the first end in the axial direction along the first rotating shaft. Furthermore, the first contact section may move in the axial direction along the first rotating shaft by making contact with the door. The second contact section may move in a cross direction by making contact with the door, the cross direction intersecting both the first rotating shaft and the third rotating shaft.

With regard to the third aspect, the door may be opened in the cross direction from the closed location. Because the first contact section disposed at the first end is closer to the door 42 than the second contact section disposed at the second end is, the length of the stroke in which the first contact section moves in the cross direction may become shorter. Because the second contact section disposed at the second end is further from the door than the first contact section disposed at the first end is, the length of the stroke in which the second contact section moves in the cross direction may become longer. At the first end, however, the first contact section may move in the axial direction in addition to the cross direction. In this case, the stroke length of the first contact section in the axial direction can be set to be longer than the stroke length in the cross direction. This can secure a long stroke length of the first contact section upon the opening of the door, compared to a configuration in which a first contact section moves only in the cross direction. Therefore, it is possible to sufficiently move the first end of the first rotating shaft, the stroke length of which may have been difficult to sufficiently secure. Sufficiently securing the stroke length of the first contact section in this manner can equally move both the first and second contact sections from the initial period in which the door is opened, thereby uniformly releasing the nipping state of the first and second rollers at the first end and the second end in the axial direction.

According to the fourth aspect of the present disclosure, the medium transport apparatus may have, in addition to the configuration of the second or third aspect, a configuration in which the first rotating shaft includes a first section that makes contact with the first moving section and a second section that makes contact with the second moving section, the first section being integrated with the second section.

With regard to the fourth aspect, the first and second ends of the first rotating shaft may be integrated with each other. In addition, the first rotating shaft moves, with the first end kept in contact with the first moving section and the second end kept in contact with the second moving section. This can stably maintain the attitude of the first rotating shaft, compared to a configuration in which a plurality of first rotating shafts are arranged side by side in the axial direction.

According to a fifth aspect of the present disclosure, the medium transport apparatus may have, in addition to the configuration of one of the first to fourth aspects, a configuration in which the support mechanism includes a rotary member that moves the first rotating shaft by rotating around a fourth rotating shaft. Furthermore, the door may have a contact section that makes contact with the rotary member at a contact point. The fourth rotating shaft may be positioned between the first rotating shaft and the contact point in a direction along the third rotating shaft, as viewed from the axial direction along the first rotating shaft.

With regard to the fifth aspect, the contact section in the door may make contact with the rotary member, thereby rotating the rotary member around the fourth rotating shaft to move the first rotating shaft. In this case, the fourth rotating shaft may be positioned, in a direction along the third rotating shaft, between the contact point and the point at which the first rotating shaft is in contact with the rotary member, the fourth rotating shaft acting as the fulcrum point of the rotary member, the contact point acting as the fulcrum point of the rotary member, the first rotating shaft acting as the working point of the rotary member. This configuration can suppress the rotary member from excessively moving. In addition, the rotational motion of the rotary member causes the first rotating shaft to move, successfully releasing the nipping state of the first and second rollers within a small space.

According to a sixth aspect of the present disclosure, the medium transport apparatus may have, in addition to the configuration of one of the first to fifth aspects, a configuration in which the support mechanism includes a pressing spring that presses the first roller against the second roller.

With regard to the sixth aspect, when returned to its previous shape after the compression, the pressing spring may apply a pressing force to the first roller. In this case, the pressing spring may press the first roller against the second roller, thereby successfully reserving a sufficient nipping pressure therebetween.

According to a seventh aspect of the present disclosure, the medium transport apparatus may have, in addition to the configuration of the sixth aspect, a configuration in which the support mechanism supports the first rotating shaft at locations outside the pressing spring in the axial direction along the first rotating shaft. Furthermore, the first rotating shaft may be warped so that a center of the first rotating shaft in the axial direction along the first rotating shaft is closer to the second roller than the first and second ends of the first rotating shaft in the axial direction are.

With regard to the seventh aspect, the nipping pressure between the first and second rollers may become higher at the center than at the first and second ends in the axial direction. This configuration can reduce the risk of the medium being torn even if a user attempts to remove a medium jamming around the nip point by strongly pulling the center of the medium in the axial direction. This is because only light loads are placed on both sides of the medium in the axial direction. Consequently, it is possible to remove the paper sheet P without its portion left around the nip point when a medium jams between the first and second rollers.

According to an eighth aspect of the present disclosure, the medium transport apparatus may have, in addition to one of the first to seventh aspects, a configuration in which the main body or the support mechanism rotatably supports the second rotating shaft.

With regard to the eighth aspect, both of the first and second rollers may be continuously supported by the support mechanism or the main body, independently of the state of the first and second rollers. Thus, even when entering the nipping state multiple times, the positional relationship between the first and second rollers is less likely to change, compared to a configuration in which a first roller is supported by a main body and a second roller is supported by a door. Therefore, the position of the second roller is maintained preciously, regardless of whether the door is open or closed.

According to a ninth aspect of the present disclosure, the medium transport apparatus may include a drive source in addition to the configuration of one of the first to eighth aspects. Furthermore, the second roller may be a drive roller rotated by drive power generated by the drive source. The first roller may be a driven roller that rotates together with rotation of the second roller.

With regard to the ninth aspect, when releasing the nipping state, only the driven roller may move. Thus, a mechanism for transferring the power from the drive source does not have to move. Therefore, the medium transport apparatus can be implemented with a simple mechanism.

According to a tenth aspect of the present disclosure, the medium transport apparatus may include, in addition to the configuration of the ninth aspect, a looped transport route along which the medium is transported. A switchback route that is coupled to the looped transport route may be a route by which the medium transported from the looped transport route is inverted and from which the inverted medium is returned to the looped transport route. The looped transport route may include: a double-side-recording route that has an infeed route via which the medium is fed to the switchback route and an ejection route via which the medium is ejected from the switchback route; and a supply route along which the medium is supplied from a meeting point at which the ejection route is merged with the supply route to a branch point at which the infeed route blanches off from the supply route. A recording section that records information on the medium may be disposed in the main body so as to face the supply route. Further, both the first roller and the recording section may be disposed outside the looped transport route; the second roller may be disposed inside the looped transport route. At least a portion of the double-side-recording route may be disposed in the door.

With regard to the tenth aspect, at least a portion of the double-side-recording route may be formed in the door. In this case, a user can remove a medium from the double-side-recording route or maintain the double-side-recording route by opening the door. In short, it is possible to easily remove a medium from the double-side-recording route or to easily maintain the double-side-recording route, compared to a configuration in which an entire double-side-recording route is formed in a main body.

According to an eleventh aspect of the present disclosure, the medium transport apparatus may have, in addition to the configuration of the tenth aspect, a configuration in which the recording section records the information on the medium by discharging liquid onto the medium and in which the second roller is a toothed roller having a circumferential surface on which a plurality of teeth are formed.

With regard to the eleventh aspect, the second roller is disposed inside the looped transport route when information is recorded on both surfaces of a medium. Thus, the first surface of the medium opposite to the second surface on which information has already been recorded makes contact with the second roller. In this case, since the second roller is a toothed roller, only portions of the circumferential surface of the second roller make contact with the first surface of the medium, as opposed to a configuration in which the entire circumferential surface of a second roller makes contact with a medium. This can suppress some of liquid that has adhered to the first surface of the medium from being transferred to the circumferential surface of the second roller.

Next, a transport section 30 and a printer 10 according to an embodiment of the present disclosure will be described below in detail with reference to the accompanying drawings. Herein, the transport section 30 is an example of a medium transport apparatus; the printer 10 is an example of a print apparatus. As illustrated in FIG. 1, the printer 10 may be an ink jet printer that records information on a paper sheet P by discharging ink Q onto the paper sheet P. In this case, the paper sheet P is an example of a medium; the ink Q is an example of a liquid. Each drawing employs an orthogonal coordinate system, or an X-Y-Z coordinate system. The ±X directions correspond to horizontal directions, or the width directions of the printer 10 when an operator views the printer 10 from the front. Further, the +X direction corresponds to the left direction, whereas the −X direction corresponds to the right direction. The ±Y directions correspond to the depth directions of the printer 10 which intersect a transport direction of a paper sheet P. Further, the +Y corresponds to the front direction, whereas the −Y corresponds to the rear direction. The ±Z directions correspond to vertical directions, or the height directions of the printer 10. Further, the +Z direction corresponds to the upper direction, whereas the −Z direction corresponds to the lower direction.

The printer 10 transports a paper sheet P along a transport route T indicated by a broken line. In this case, a transport direction of the paper sheet P changes at some locations on the transport route T. The printer 10 includes: a main body 12 that forms a casing as an outer shell of the printer 10; the transport section 30 (described in detail later); and a line head 28. The main body 12 includes: an ejecting section 13 that is disposed near the side in the +Z direction (+Z-directional side) and that contains space to which a paper sheet P on which information has been recorded is to be ejected; a plurality of paper cassettes 14 arranged side by side near the side in the −Z direction (−Z directional side); and an aperture 12A on the side in the −X direction (−X-directional side), via which the transport route T (described in detail later) is exposed. Furthermore, as an example, a portion of the main body 12 forms the main body of the transport section 30. The main body 12 supports a support unit 70 (described in detail later).

Each of the paper cassettes 14 accommodates one or more paper sheets P. From each paper cassette 14, the paper sheets P are sequentially transported along the transport route T by a corresponding pickup roller 16 and corresponding transport roller pairs 17 and 18. The transport route T is merged with a transport path T1 and a transport path T2. Along the transport path T1, a paper sheet P is to be fed from an external apparatus (not illustrated); along a transport path T2, a paper sheet P is to be fed by an infeed roller pair 26 from a manual paper feed tray 19 disposed in the main body 12. It should be noted that components disposed inside the printer 10 on the −X-directional side with respect to the center constitute the transport section 30, which is an example of a transport apparatus that transports a paper sheet P. Details of the transport section 30 will be described later.

Arranged along the transport route T are two pulleys 21, a transport belt 22 looped between the pulleys 21, a plurality of transport roller pairs 24 each of which transports a paper sheet P, a plurality of flaps 25 each of which switches between routes to which the paper sheet P is to be transported, and a medium width sensor 20 that detects the length of the paper sheet P in the +Y direction. The transport route T includes ejection paths T3, an infeed route T4, a switchback route TB, an ejection route T5, and a supply route TS.

Each of the ejection paths T3 is a route formed from the supply route TS to an ejecting section 13. The infeed route T4 is a route via which a paper sheet P is to be fed from the supply route TS to the switchback route TB. The ejection route T5 is a route along which a paper sheet P is to be fed from the switchback route TB and is merged with the supply route TS. A combination of the infeed route T4 and the ejection route T5 is referred to as a double-side-recording route TM. The switchback route TB is a route coupled to a looped transport route TR (described later). In this case, the switchback route TB may extend in the +Z direction. When transported from the looped transport route TR to the switchback route TB, a paper sheet P is inverted and then returned to the looped transport route TR.

The supply route TS is a route along which a paper sheet P is to be supplied from a meeting point A at which the ejection route T5 is merged with the supply route TS to a branch point B at which the infeed route T4 is branched off from the supply route TS. The looped transport route TR is provided with the double-side-recording route TM and the supply route TS. A portion of the double-side-recording route TM is disposed in a door 42 (described in detail later). As described above, both the switchback route TB and the looped transport route TR along which a paper sheet P is to be transported are disposed in the transport section 30, as viewed from the side in the +Y direction (+Y-directional side).

The main body 12 further includes: an ink tank 27 that stores an ink Q; the line head 28; and a controller 29 that controls operations of components in the printer 10. The line head 28 is disposed downstream of the medium width sensor 20 in the transport direction of a paper sheet P so as to face the supply route TS. The line head 28, which is an example of a recording section, is supplied with the ink Q from the ink tank 27 and then discharges the ink Q onto a paper sheet P being transported by the transport section 30, thereby recording information thereon. The controller 29, which may include a central processing unit (CPU), read only memory (ROM), random access memory (RAM), and a storage unit, controls transporting of paper sheets P inside the printer 10 and operations of some components, such as the line head 28 and the transport section 30.

Figure 5:
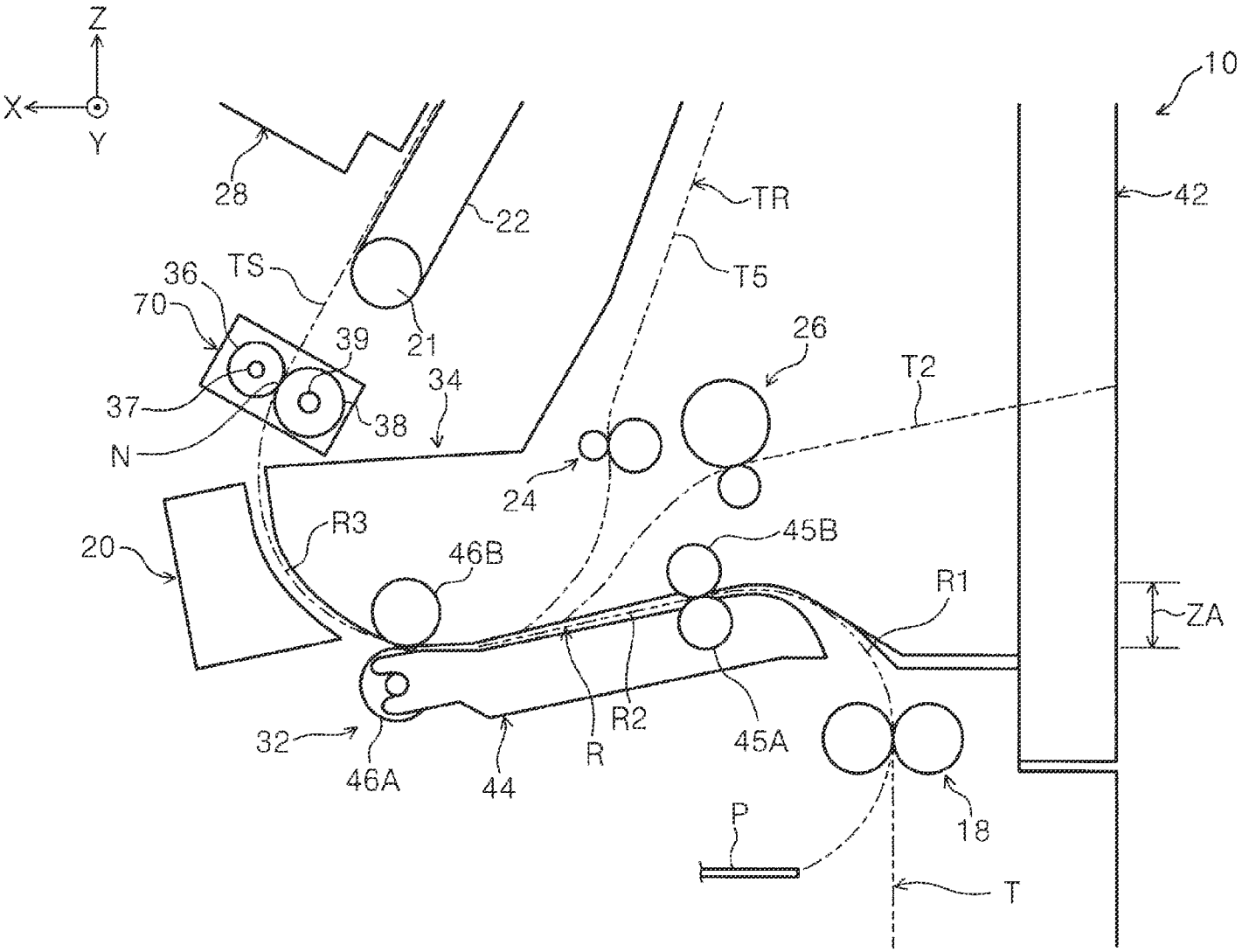
FIG. 5 is a partly enlarged, schematic view of the transport route in the transport section.

As illustrated in FIG. 5, a curved route R is formed along a portion of the transport route T and upstream of the medium width sensor 20. The curved route R is a route having a pair of upward and downward slopes. More specifically, the curved route R includes an introduction route R1, a descent route R2, and an ascent route R3: the introduction route R1 is curved in the +X and +Z directions from the transport roller pair 18; the descent route R2 is curved in the +X and −Z directions from the end of the introduction route R1 in the +X direction; and the ascent route R3 is curved in the +X and +Z directions from the end of the descent route R2 in the +X direction.

The descent route R2 is a route along which a paper sheet P is to be transported in the +X and −Z directions. The ascent route R3 is a route which is disposed downstream of the descent route R2 in the transport direction of a paper sheet P and along which a paper sheet P is to be transported in the +Z direction. The descent route R2 and the ascent route R3 are defined by an upper guide 34 and a lower guide 32 (see FIG. 2), both of which will be described in detail later. As viewed from the −X-directional side, the descent route R2 in the transport route T covers the ascent route R3 within an area ZA.

Figure 2:
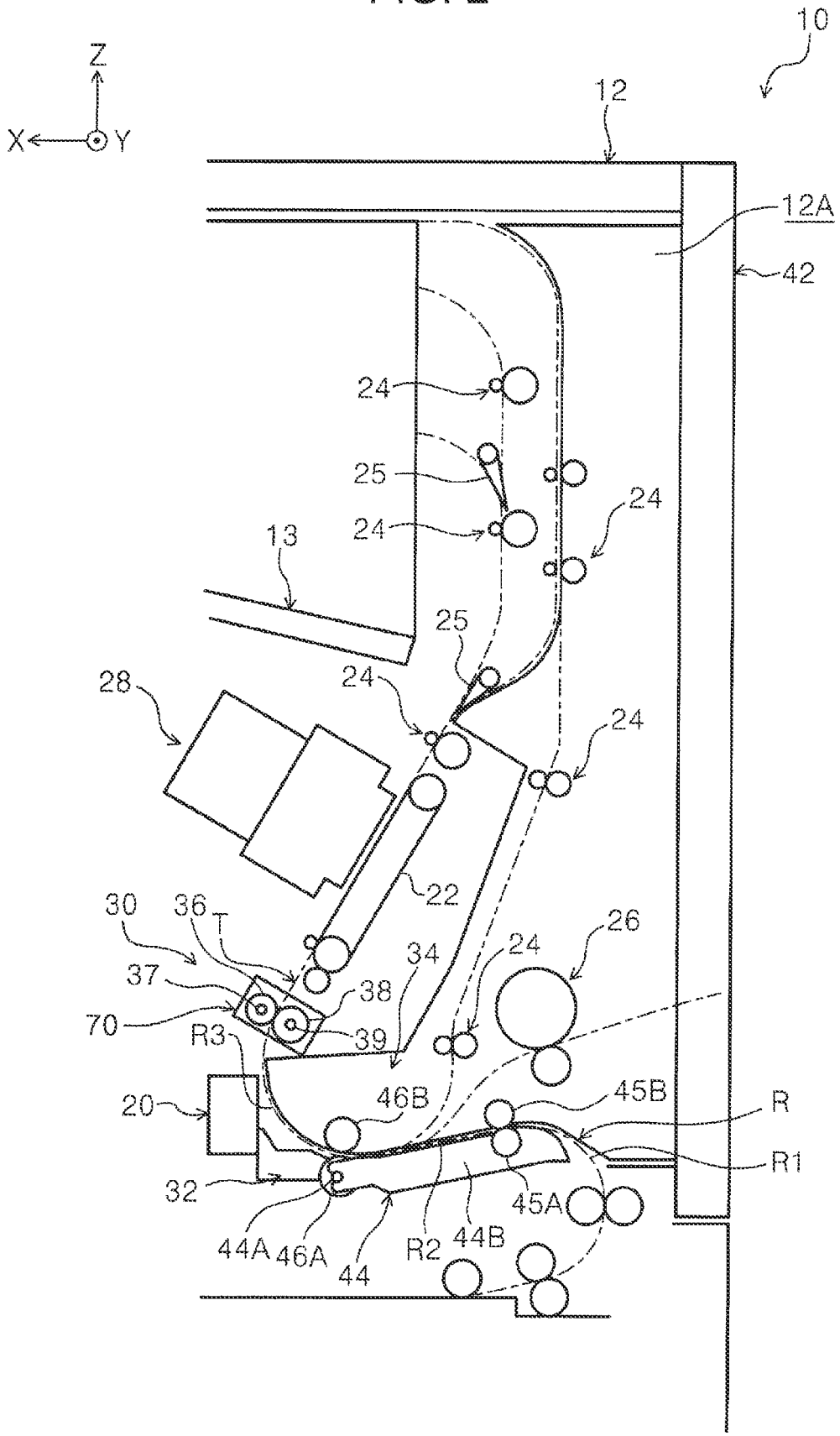
FIG. 2 is a schematic view of the transport route for paper sheets inside the printer with the door closed.
Figure 4:
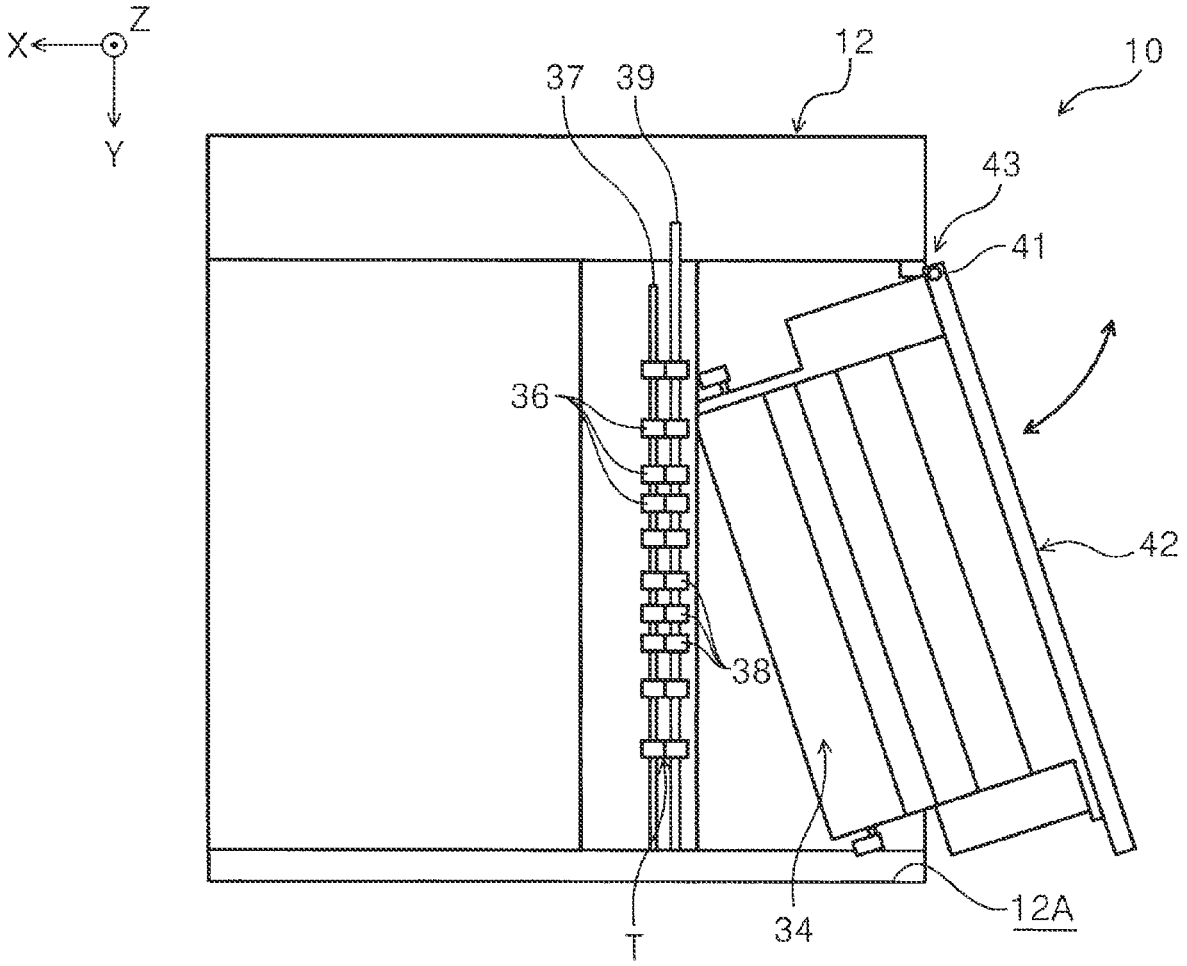
FIG. 4 is a plan view of the transport route for paper sheets inside the printer with the door open.

As illustrated in FIG. 2, for example, the transport section 30 includes a plurality of first rollers 36, a plurality of second rollers 38, a first rotating shaft 37, a second rotating shaft 39, a support unit 70, the main body 12, the door 42, and a third rotating shaft 41 (see FIG. 4). Of the components in the transport section 30, those disposed in the main body 12 are collectively referred to as the lower guide 32, and those disposed in the door 42 are collectively referred to as the upper guide 34.

Figure 3:
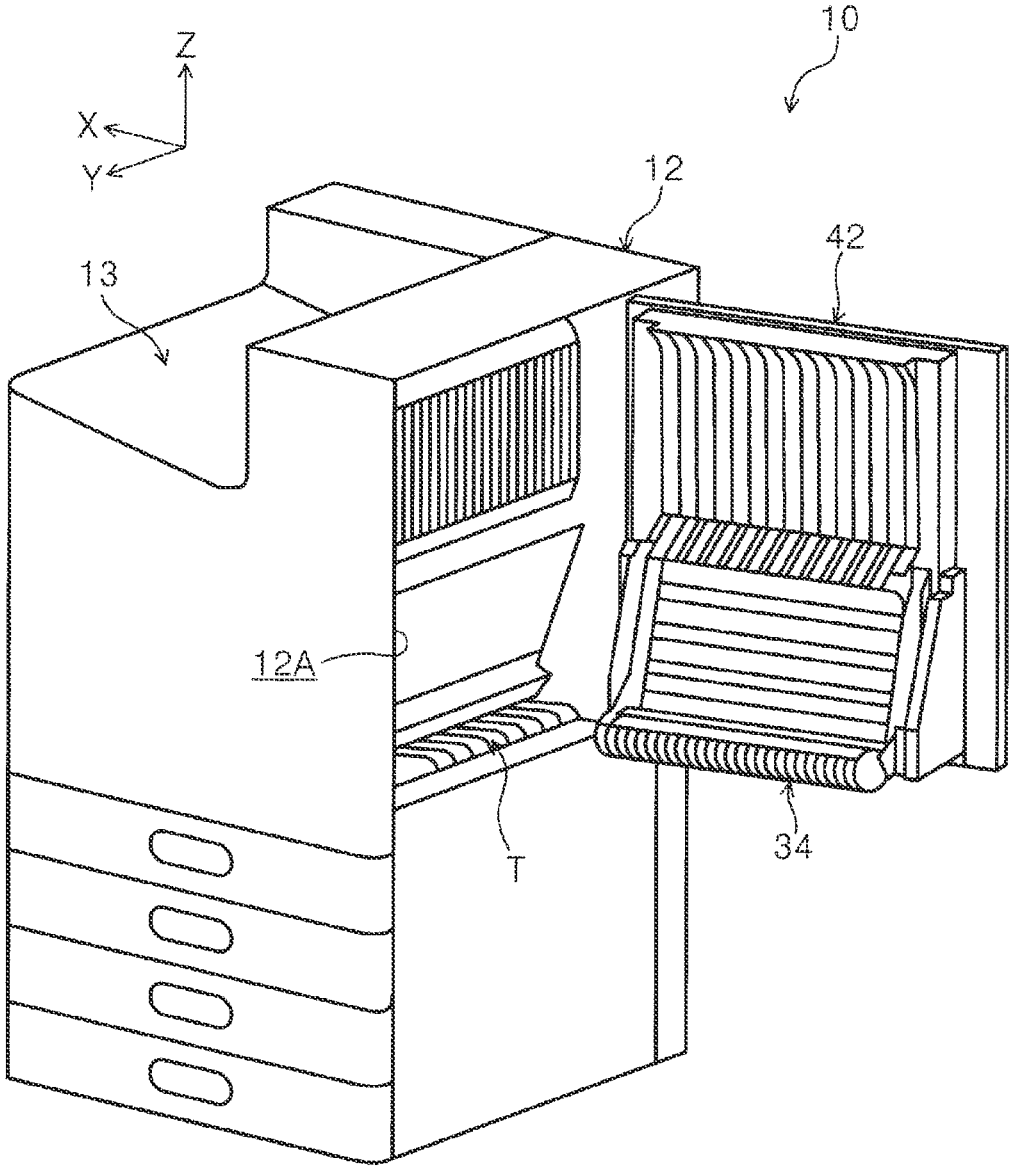
FIG. 3 is a perspective view of the transport route for paper sheets inside the printer with the door open.

As illustrated in FIG. 3, the door 42 may have a tabular shape with a predetermined thickness. By rotating the door 42 to open the door 42, the transport route T can be exposed via the aperture 12A. By rotating the door 42 to close the door 42, the transport route T can be hidden. In short, the door 42 can be rotated to move between an open location at which the transport route T is exposed and a closed location at which the transport route T is hidden. When being in the closed location, the door 42 forms a portion of the outer shell of the main body 12. The door 42 includes a contact member 53 (see FIG. 8) and a contact member 56 (see FIG. 7).

As illustrated in FIG. 2, the lower guide 32 is provided with the first rollers 36, the second rollers 38, the first rotating shaft 37, the second rotating shaft 39, the support unit 70, a guide member 44, an upstream roller 45A, and a downstream roller 46A. The upstream roller 45A forms a nip mechanism in collaboration with an upstream roller 45B in the upper guide 34; the downstream roller 46A forms a nip mechanism in collaboration with a downstream roller 46B in the upper guide 34. The guide member 44 includes: a shaft 44A extending in the +Y direction; and a body 44B rotatable around the shaft 44A. When the door 42 is closed, the guide member 44 forms the descent route R2. When the door 42 is opened, the guide member 44 moves away from the descent route R2. The upstream roller 45A is disposed on the body 44B; the downstream roller 46A is disposed around the shaft 44A.

The upper guide 34 is provided with the transport roller pair 24, the infeed roller pair 26, the upstream roller 45B, and the downstream roller 46B. When attached to the door 42, the upper guide 34 is movable outwardly from the main body 12 together with the door 42. When contained in the main body 12, the upper guide 34 is positioned on the +Z-directional sides of the descent route R2 and the ascent route R3.

Figure 7:
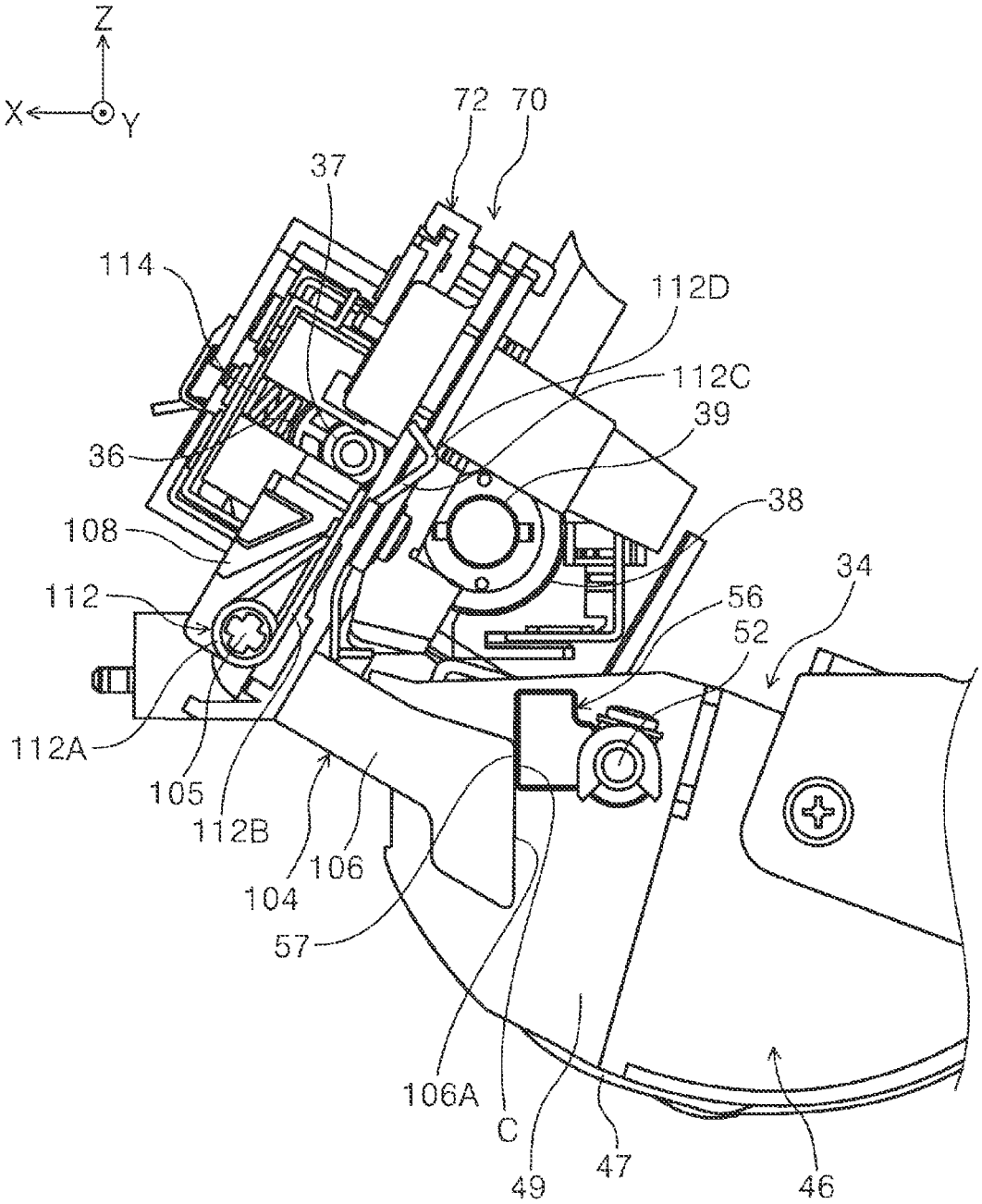
FIG. 7 illustrates the front sides of the support unit and the upper guide with the door in the transport section closed.
Figure 8:
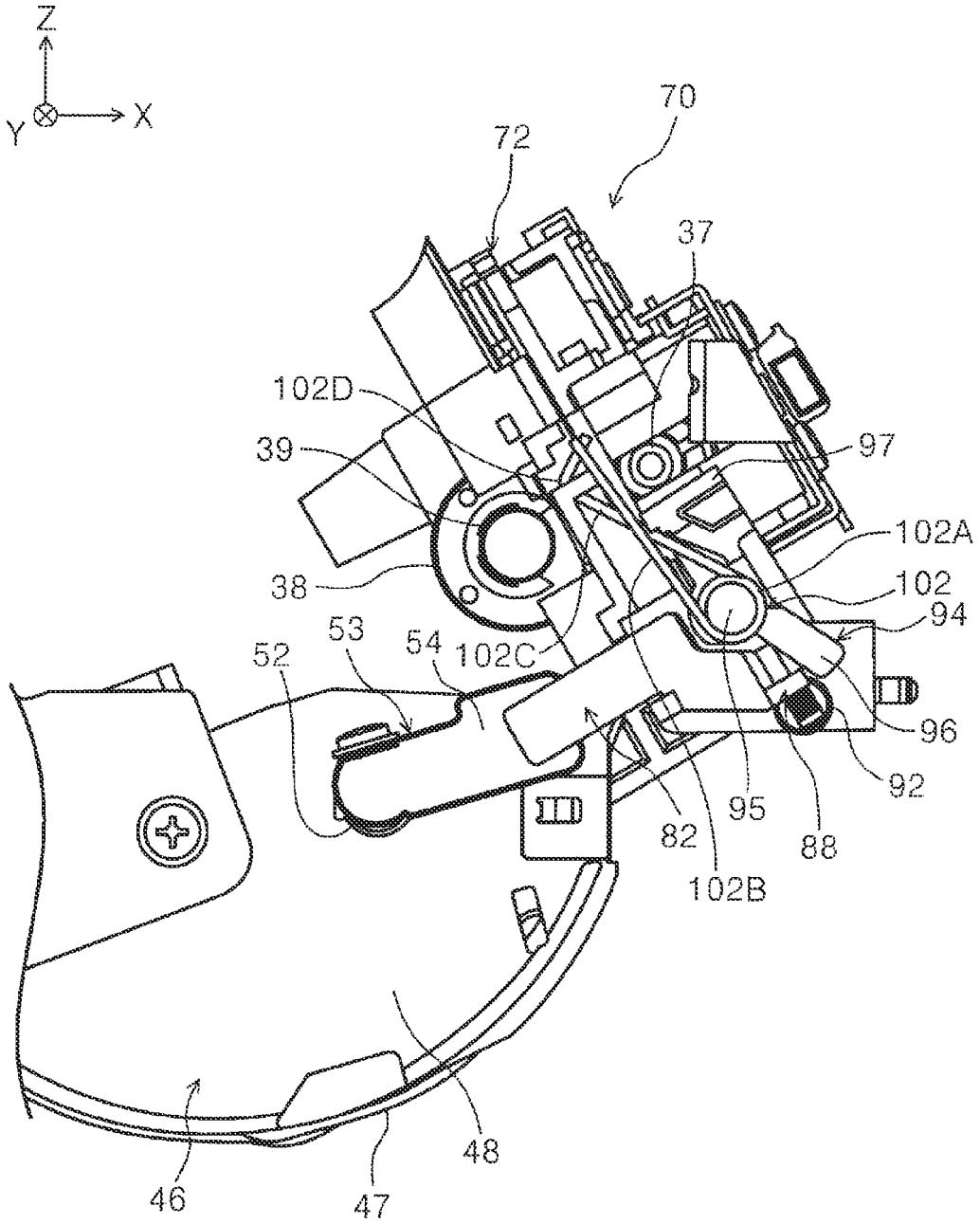
FIG. 8 illustrates the rear sides of the support unit and the upper guide with the door in the transport section closed.

As illustrated in FIG. 8, the upper guide 34 has a body member 46 that includes: a bottom wall 47 bulging in the −Z direction; a side wall 48 erected from the side of the bottom wall 47 in the −Y direction (the −Y-directional side of the bottom wall 47); and a side wall 49 (see FIG. 7) erected from the +Y-directional side of the bottom wall 47. Furthermore, a shaft 52, which may have a cylindrical shape, penetrates both the side walls 48 and the 49 in the +Y direction, with a first end thereof protruding from the side wall 48 in the −Y direction and a second end thereof protruding from the side wall 49 in the +Y direction. As an example, the shaft 52 does not rotate. The first end of the shaft 52 is fixed to the contact member 53, which may be a block member having a substantially L-shape as viewed from the −Y-directional side. In addition, a contact surface 54, which may expand in the X-Z plane, is formed on the −Y-directional side of the contact member 53. The contact member 53, which is an example of a contact section, is in contact with a first contact member 82 (described in detail later) at a contact point.

As illustrated in FIG. 7, the +Y-directional end of the shaft 52 is fixed to the contact member 56, which may be a block member extending from the shaft 52 in the +X and +Z directions as viewed from the +Y-directional side. In addition, a contact surface 57, which may expand in the Y-Z plane, is formed on the side of the contact member 56 in the +X direction (the +X-directional side of the contact member 56). As described above, the contact surface 54 (see FIG. 8) is disposed so as to be able to make contact with anything present on the −Y-directional side thereof. Likewise, the contact surface 57 is disposed so as to be able to make contact with anything present on the +X-directional side thereof. The contact member 56, which is an example of a contact section, is in contact with a second contact member 104 (described in detail later) at a contact point. In this embodiment, both of the contact members 53 and 56 are disposed in the door 42 (see FIG. 2).

As illustrated in FIG. 4, the door 42 is attached to the −X-directional side of the main body 12 via a hinge 43, which is disposed on the −Y-directional side of the aperture 12A; the hinge 43 is provided with the third rotating shaft 41. The third rotating shaft 41, which may have a cylindrical shape, extends in the +Z direction. In addition, the third rotating shaft 41 is disposed on the −X-directional side of the main body 12 and adjacent to the −Y-directional side of the main body 12. In short, the third rotating shaft 41 is disposed adjacent to one of the ±Y-directional sides of the main body 12. Furthermore, the third rotating shaft 41 intersects the first rotating shaft 37 (described in detail later) as viewed from the +X- or −X-directional side. When being opened or closed, the door 42 rotates around the third rotating shaft 41 and between the closed location and the open location. In this way, the door 42 exposes the transport route T inside the main body 12 via the aperture 12A or hides the transport route T by covering the aperture 12A.

As illustrated in FIG. 5, the first rollers 36 and the line head 28 are positioned outside the looped transport route TR, but the second rollers 38 are positioned inside the looped transport route TR, as viewed from the +Y-directional side. Both the first rollers 36 and the second rollers 38 transport a paper sheet P by nipping the paper sheet P therebetween at a nip point N.

Figure 9:
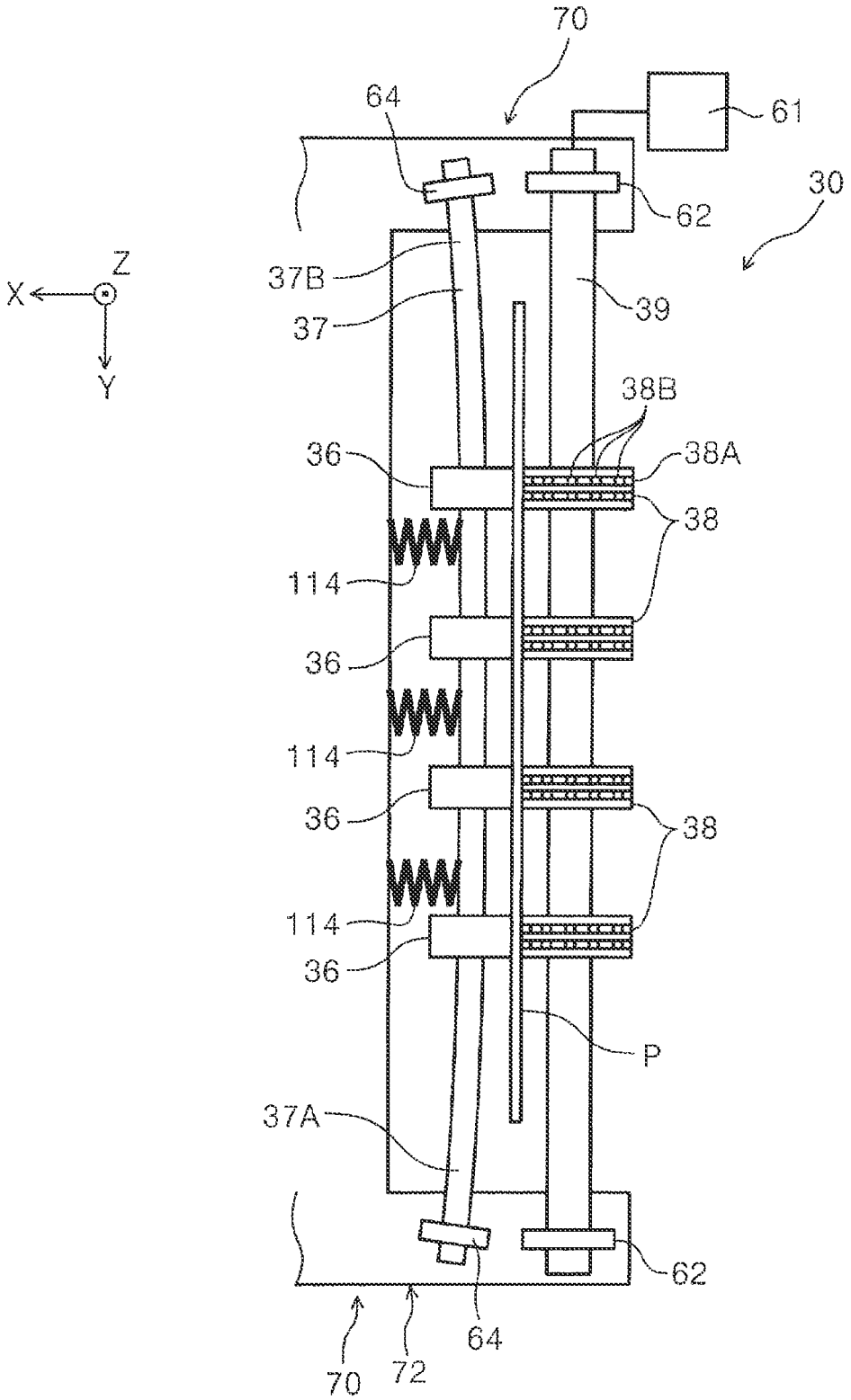
FIG. 9 is a plan view of the first rotating shaft in the transport section which is warped at the center.

As illustrated in FIG. 9, the transport section 30 includes a motor 61, which is an example of a drive source. The second rotating shaft 39 extends in the +Y direction and rotatably supports the second rollers 38. The ±Y-directional ends of the second rotating shaft 39 are rotatably supported by respective bearings 62, which are attached to a unit body 72 (described in detail later) in the support unit 70. In this embodiment, the support unit 70 rotatably supports the second rotating shaft 39. Since the support unit 70 is supported by the main body 12 (see FIG. 2), the second rotating shaft 39 can be interpreted as being indirectly supported by the main body 12. Each of the second rollers 38, which is an example of a drive roller and a toothed roller, is rotated by drive power generated by the motor 61. Each second roller 38 has a circumferential surface 38A on which a plurality of teeth 38B are formed. Each of the teeth 38B may have a trapezoidal shape as viewed from the +Y- or −Y-directional side.

The first rotating shaft 37 extends in the +Y direction and rotatably supports the first rollers 36. The ±Y-directional ends of the first rotating shaft 37 are rotatably supported by respective bearings 64, which are attached to the unit body 72. In this embodiment, the unit body 72 rotatably supports both the first rotating shaft 37 and the second rotating shaft 39. Since the support unit 70 is supported by the main body 12, both the first rotating shaft 37 and the second rotating shaft 39 can be interpreted as being indirectly supported by the main body 12. The +Y-directional end of the first rotating shaft 37 has a circumference 37A, which makes contact with an arm 112C (see FIG. 7), details of which will be described later. Likewise, the −Y-directional end of the first rotating shaft 37 has a circumference 37B, which makes contact with an arm 102C (see FIG. 8), details of which will be described later. In this case, the first rotating shaft 37 may be integrated with both the circumferences 37A and 37B. The first rollers 36, which are an example of a driven roller, rotate together with the rotation of the corresponding second rollers 38.

As illustrated in FIG. 7, the support unit 70, which is an example of a support mechanism, supports both the first rotating shaft 37 and the second rotating shaft 39. When the door 42 (see FIG. 2) is rotated from the closed location to the open location, the support unit 70 moves the first rotating shaft 37 from the nip point N (see FIG. 5) to an escaped point. It should be noted that the escaped point of the first rotating shaft 37 is further in the +X direction from the first rollers 36 at the nip point N than the nip point N.

Figure 6:
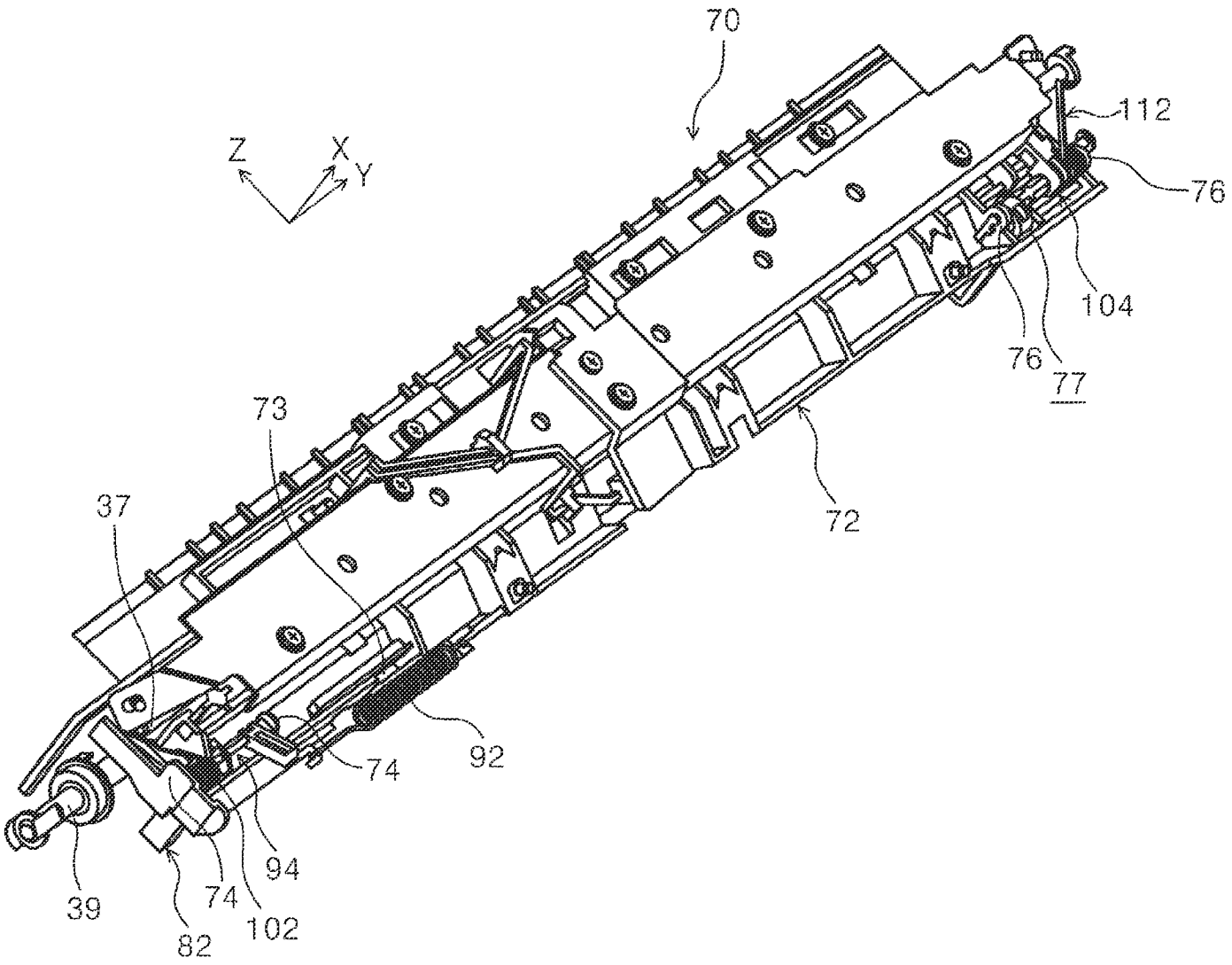
FIG. 6 is a perspective view of the support unit that supports the first transport rollers and the second transport rollers.

As illustrated in FIG. 6, for example, the support unit 70 includes a unit body 72, the first contact member 82, a tension spring 92, a conversion member 94, a first torsion spring 102, the second contact member 104, a second torsion spring 112, and a plurality of pressing springs 114 (see FIG. 9). The unit body 72 includes a plurality of members elongated in the +Y direction. Hereinafter, the +Y-directional side of the unit body 72 with respect to the center is referred to as the front side, whereas the −Y-directional side of the unit body 72 with respect to the center is referred to as the rear side. In this case, the rear side is an example of a first end of the first rotating shaft 37 in an axial direction, whereas the front side is an example of a second end of the first rotating shaft 37 in the axial direction.

A slit 73, which partly penetrates the unit body 72 in the −X direction and extends in the +Y direction, is formed near the rear side of the unit body 72. A pair of support walls 74, which are spaced in the +Y direction and have respective through-holes passing therethrough in the +Y direction, are formed near the rear side of the unit body 72 and on the +Z-directional side of the slit 73. A suppression wall 75 (see FIG. 10), which has a predetermined thickness in the +Z direction and protrudes from the unit body 72 in the +X direction, is formed near the +Z-directional sides of the support walls 74. A pair of support walls 76, which are spaced in the +Y direction and have respective through-holes passing therethrough in the +Y direction, are formed near the front side of the unit body 72. A through-hole 77, which passes through the unit body 72 in the +X direction, is formed between the pair of support walls 76.

Figure 10:
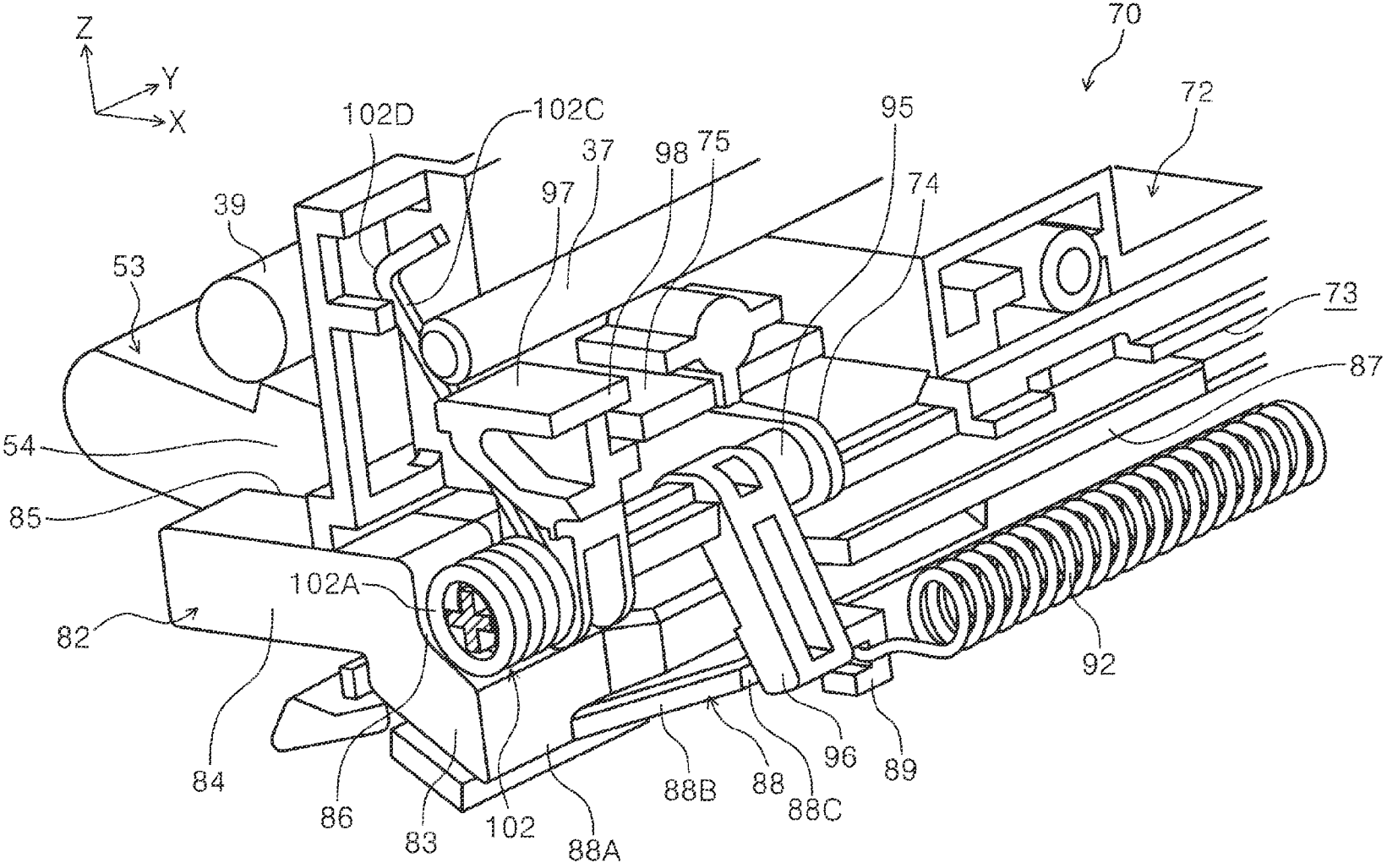
FIG. 10 is an enlarged, perspective view of the rear side of the support unit in the transport section.
Figure 11:
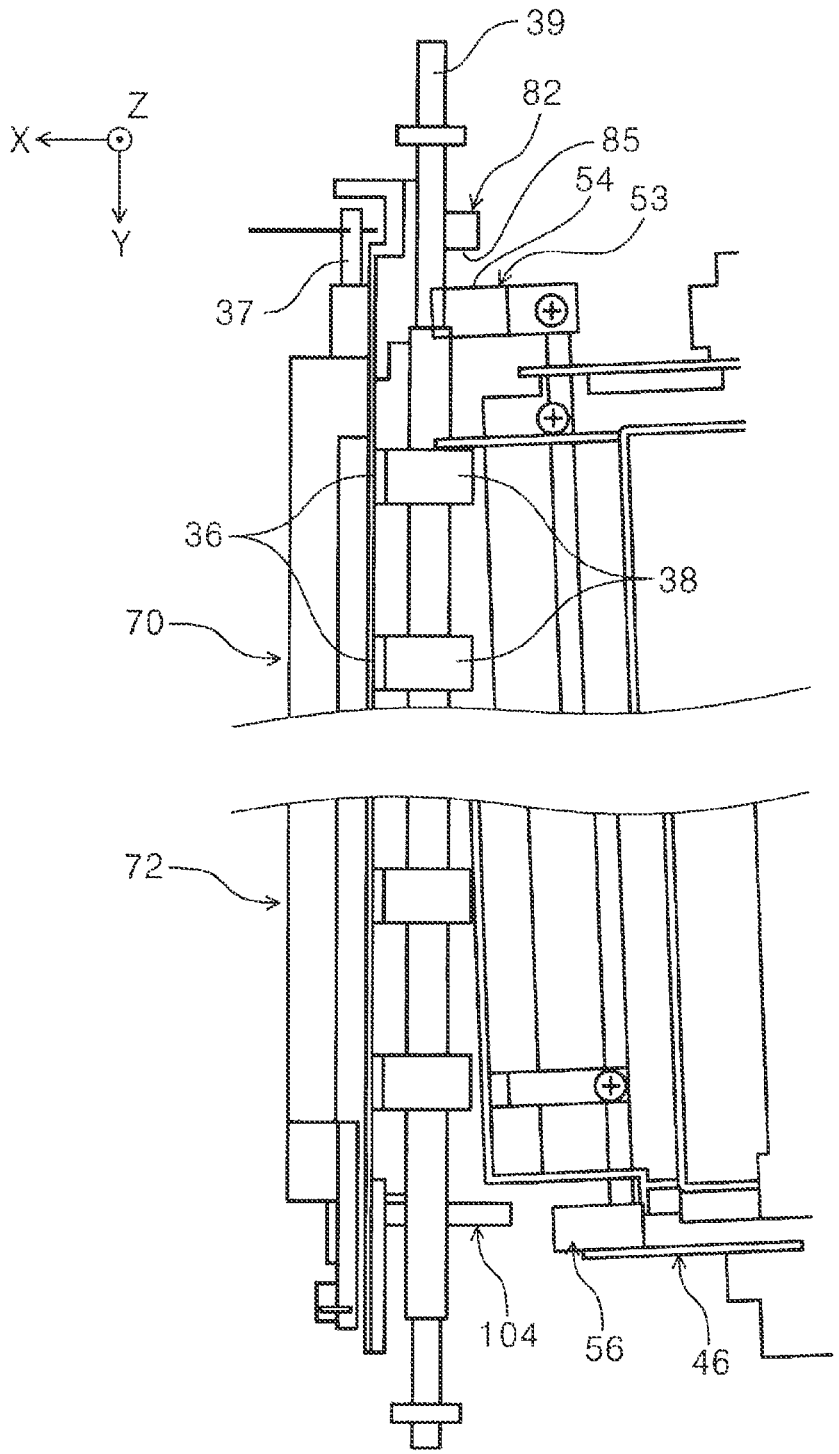
FIG. 11 is a partial, plan view of the front and rear portions of the support unit in the transport section.
Figure 12:
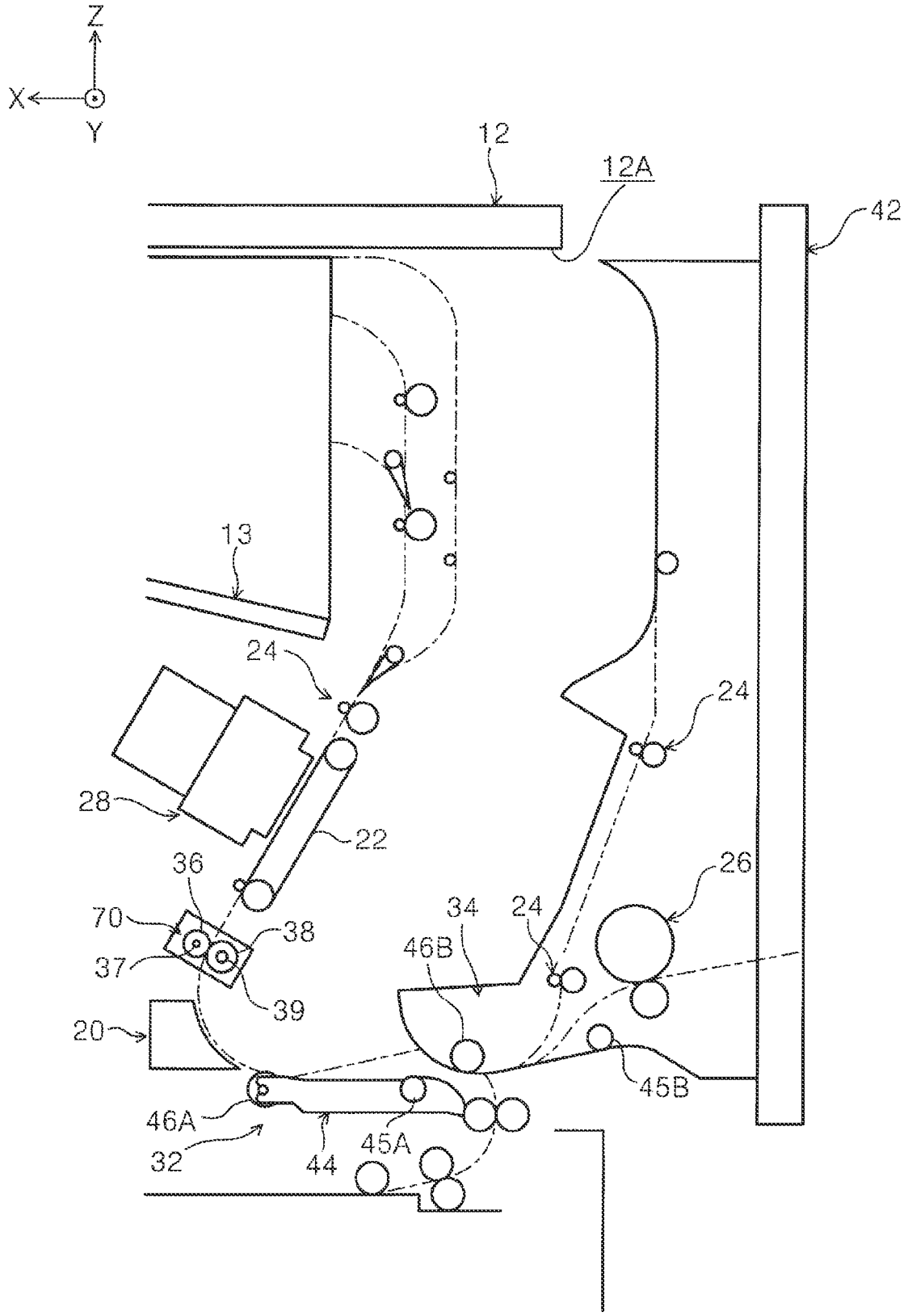
FIG. 12 is a schematic view of the printer with the transport route for paper sheets open.
Figure 13:
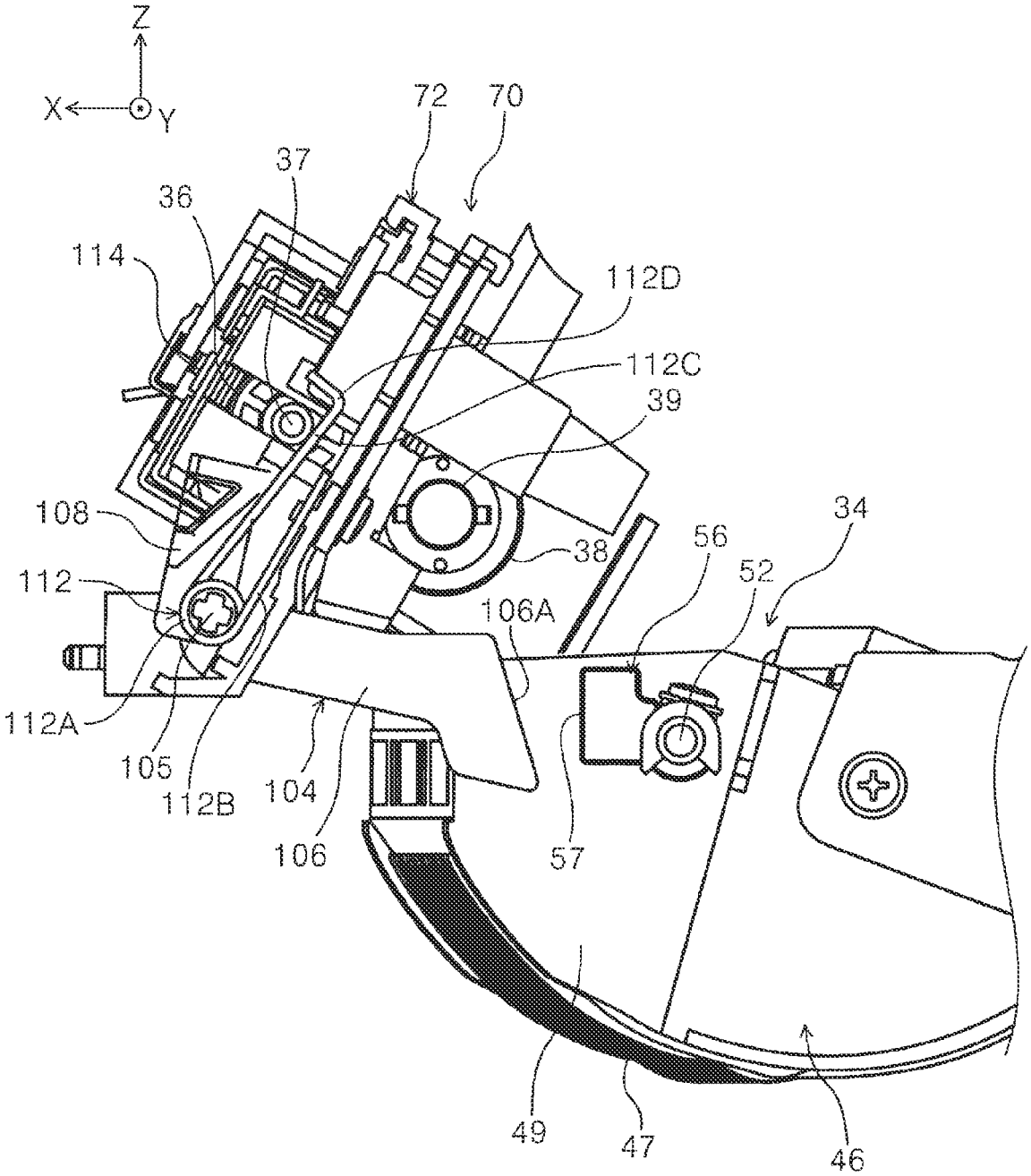
FIG. 13 illustrates the front sides of the support unit and the upper guide with the door in the transport section open.
Figure 14:
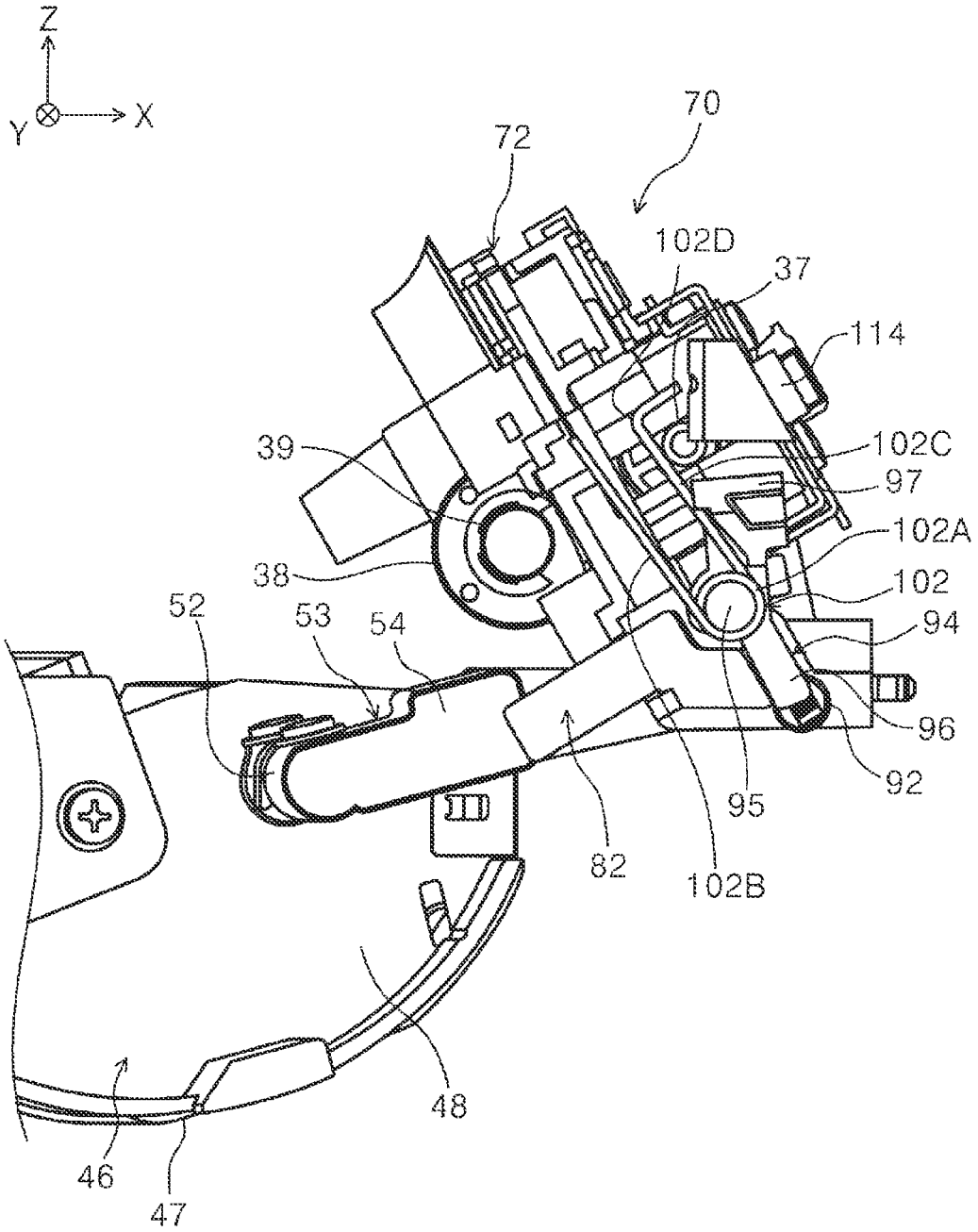
FIG. 14 illustrates the rear sides of the support unit and the upper guide with the door in the transport section open.

As illustrated in FIG. 10, the first contact member 82, which is an example of a first contact section, has a rear side that can make contact with the contact member 53. The first contact member 82 moves in the ±Y directions, which correspond to the axial directions along the first rotating shaft 37, by making contact with the contact member 53. The first contact member 82 includes a base 83, a lever 84, a step 86, a flange 87, a slope 88, and a hook section 89.

The base 83, which has a tabular shape with a predetermined thickness in the +Z direction and extends in the +Y direction, is to be inserted into the slit 73 and movable in the ±Y directions relative to the unit body 72. The lever 84 extends in the −X direction from the −Y-directional side of the base 83. The lever 84 is disposed while shifted in the +Z direction from the base 83. Thus, the +X-directional side of the lever 84 and the +X-directional side of the base 83 form the step 86. The lever 84, which may have a rectangular parallelepiped shape, has a contact surface 85 on the +Y-directional side. The contact surface 85, which expands in the X-Z plane, is movable in the +Y direction to make contact with the contact surface 54.

The flange 87 overhangs in the +X direction from the +X-directional side of the base 83 while being slightly shifted from the center to the +Y-directional side. The slope 88 is formed on the +X-directional side of the base 83 while shifted from the center to the −Y- and −Z-directional side. As an example, the slope 88 includes a first side surface 88A, an inclined surface 88B, and a second side surface 88C. The first side surface 88A expands in the Y-Z plane. The inclined surface 88B extends in the +X and +Y directions from the +Y-directional side of the first side surface 88A. The second side surface 88C, which expands in the Y-Z plane, extends from the +Y-directional side of the inclined surface 88B toward the flange 87. The second side surface 88C is positioned near the +X-directional side of the first side surface 88A. The hook section 89 protrudes in the −Z direction from the +Y-directional side of the slope 88. The hock section 89, which may have a substantially U-shape as viewed from the +X-directional side, has a recess formed in the +Y direction.

The tension spring 92 is disposed so as to be elastically deformable in the ±Y directions. The +Y-directional end of the tension spring 92 is coupled to the unit body 72, whereas the −Y-directional end of the tension spring 92 is hooked on the hook section 89. As a result, the first contact member 82 is pulled in the +Y direction. When the first contact member 82 is not in contact with the contact surface 54, the tension spring 92 is kept at its natural length. When brought into contact with the contact surface 54, the first contact member 82 is moved and pulled in the −Y direction. The first contact member 82 is suppressed from moving in the ±X directions by a guide (not illustrated) and thus movable only in the ±Y directions.

As an example, the conversion member 94 includes a support shaft 95, a first extension 96, a second extension 97, and a suppression section 98. The support shaft 95, which extends in the +Y direction, is rotatably supported at the ±Y-directional ends by the respective support walls 74. The first extension 96 extends in a direction orthogonal to the +Y direction from a portion of the support shaft 95 between the center and the +Y-directional end. The first extension 96 is positioned on the −Z-directional side of the support shaft 95 so as to be able to make contact with the slope 88. The second extension 97 extends in a direction orthogonal to the +Y direction from a portion of the support shaft 95 between the center and the −Y-directional side of the support shaft 95. The suppression section 98, which may have a substantially U-shape as viewed from the +Z directional side, is formed on the +Z- and +Y-directional sides of the second extension 97 and has a recess formed in the −Y direction. The suppression section 98 suppresses excessive rotation of the conversion member 94 by making contact with the suppression wall 75. In other words, the suppression section 98 reduces a rotational range of the conversion member 94.

The first torsion spring 102, which is an example of a first moving section, receives a force generated by the contact between the first contact member 82 and the contact member 53, thereby moving the rear end of the first rotating shaft 37 in the +X direction. The first torsion spring 102 includes: a looped section 102A having a cylindrical shape; an arm 102B (see FIG. 8) that extends from the −Y-directional end of the looped section 102A; an arm 102C that extends from the +Y-directional end of the looped section 102A; and a curved section 102D. The looped section 102A is wound around and supported by the −Y-directional end of the support shaft 95 while facing the step 86.

As illustrated in FIG. 8, the arm 102B linearly extends along the unit body 72 from the looped section 102A while being fixed to the unit body 72. The arm 102C is in contact with the −X-directional side of the second extension 97. The conversion member 94 receives a rotational force in the clockwise direction, as viewed from in the −Y-directional side, by making contact with the arm 102C. The curved section 102D is disposed at the end of the arm 102C and extends from the arm 102C in the +X and +Z directions.

As illustrated in FIG. 7, the second contact member 104, which is an example of a second contact section and a rotary member, has a front side that can make contact with the contact member 56. The second contact member 104 rotates clockwise, as viewed from the +Y-directional side, by making contact with the contact member 56. In other words, the second contact member 104 moves in a cross direction that intersects both the first rotating shaft 37 and the third rotating shaft 41 (see FIG. 4) by making contact with the contact member 56. In this case, the location at which the second contact member 104 makes contact with the contact member 56 is referred to as the contact point C. The second contact member 104 includes a fourth rotating shaft 105, a first extension 106, and a second extension 108. The second contact member 104 is rotatable around the fourth rotating shaft 105.

The fourth rotating shaft 105 extends in the +Y direction with the ±Y-directional ends thereof rotatably supported by the respective support walls 76 (see FIG. 6). The fourth rotating shaft 105 is positioned between the first rotating shaft 37 and the above contact point C in the +Z direction in which the third rotating shaft 41 (see FIG. 4) extends, as viewed from the +Y-directional side. In other words, the fourth rotating shaft 105 is positioned within the area defined by a virtual line (not illustrated) that extends in the +X direction and passes through the rotational center of the first rotating shaft 37 and another virtual line (not illustrated) that extends in the +X direction and passes through the contact point C.

The first extension 106 extends in a direction orthogonal to the +Y direction from a portion of the fourth rotating shaft 105 between the center and the +Y-directional side. The first extension 106 is positioned near the −Z-directional side of the fourth rotating shaft 105. The first extension 106 is positioned so as to be able to make contact with the contact member 56. One of the ends of the first extension 106 which is further from the fourth rotating shaft 105 is curved in the −Z direction. In this case, the surface of the portion of the first extension 106 which makes contact with the contact member 56 is referred to as a contact surface 106A. The second extension 108 extends in a direction orthogonal to the +Y direction from a portion of the fourth rotating shaft 105 between the center and the −Y-directional side. The second extension 108 is positioned at the +Z-directional end of the fourth rotating shaft 105. Both the second extension 108 and the first extension 106 are arranged in an L-shape fashion, as viewed from the +Y-directional side.

The second torsion spring 112, which is an example of a second moving section, receives the force generated by the contact between the second contact member 104 and the contact member 56, thereby moving the front end of the first rotating shaft 37 in the +X direction. The second torsion spring 112 includes: a looped section 112A having a cylindrical shape; an arm 112B extending from the end of the looped section 112A in the +Y direction; an arm 112C extending from the end of the looped section 112A in the −Y direction; and a curved section 112D. The arm 112C makes contact with the first rotating shaft 37 to move the first rotating shaft 37 in the +X direction. The looped section 112A is wound around and supported by the +Y-directional end of the fourth rotating shaft 105.

As illustrated in FIG. 9, the support unit 70 is provided with the pressing springs 114 that press the first rollers 36 against the corresponding second rollers 38. Each of the pressing springs 114 has a first end coupled to the unit body 72 and a second end that pushes, in the −X direction, substantially the center of the first rotating shaft 37 in the +Y direction. Disposing the pressing springs 114 in this manner presses the first rollers 36 against the corresponding second rollers 38. The unit body 72 supports the first rotating shaft 37 at locations outside the pressing springs 114 in the +Y direction. The first rotating shaft 37 is warped by pressing forces generated by the respective pressing springs 114 so that the central portion of the first rotating shaft 37 is closer to the second rollers 38 than the +Y-directional ends thereof are. It should be noted that in FIG. 9, the warping of the first rotating shaft 37 is illustrated exaggeratively for a better understanding of the state of the first rotating shaft 37.

Next, functions of the transport section 30 and the printer 10 will be described in detail below. As illustrated in FIGS. 10 to 12 and 14, when a user opens the door 42 that has covered the aperture 12A, the contact member 53 disposed on the rear side of the support unit 70 becomes separated from the first contact member 82 by moving in the +Y direction. The first contact member 82 is then moved in the +Y direction by the tensile force of the tension spring 92. Simultaneously, the first extension 96 is slid from the second side surface 88C to the first side surface 88A along the slope 88. As a result, the conversion member 94 is rotated clockwise as viewed from the −Y direction. The clockwise rotation of the conversion member 94 brings the arm 102C into contact with the −Y-directional end of the first rotating shaft 37, thereby pushing the −Y-directional end of the first rotating shaft 37 in the +X direction.

As illustrated in FIGS. 10 to 13, when the user opens the door 42, the contact member 56 disposed on the front side of the support unit 70 becomes separated from the second contact member 104. The second contact member 104 is then rotated counterclockwise as viewed from the +Y-directional side. The counterclockwise rotation of the second contact member 104 brings the arm 112C into contact with the +Y-directional end of the first rotating shaft 37, thereby pushing the +Y-directional end of the first rotating shaft 37 in the +X direction. In this way, the ±Y-directional ends of the first rotating shaft 37 are pushed in the +X direction, so that the first rollers 36 moves away from the corresponding second rollers 38.

When the user rotates and closes the door 42, the contact member 56 makes contact with the second contact member 104 to rotate the second contact member 104 clockwise on the front side of the support unit 70, thereby moving the arm 112C away from the first rotating shaft 37.

Simultaneously, the first contact member 82 makes contact with the contact member 53 to rotate the conversion member 94 counterclockwise on the rear side of the support unit 70, thereby moving the arm 102C away from the first rotating shaft 37. After both the arms 112C and 102C have moved away from the first rotating shaft 37, the first rotating shaft 37 receives the pressing forces from the pressing springs 114, thereby bringing the first rollers 36 into contact with the corresponding second rollers 38. In this way, the first rollers 36 and the second rollers 38 can nip a paper sheet P therebetween.

In the transport section 30, as described above, when a user opens the door 42 in the transport section 30 by rotating the door 42 around the third rotating shaft 41, the support unit 70 moves the first rotating shaft 37 from the nip point to the escaped point, thereby releasing the nipping state of the first rollers 36 and the second rollers 38. Since the support unit 70 that releases the nipping state is disposed in the main body 12, the door 42 can be implemented with a simple, lightweight mechanism.

In the transport section 30, both the first torsion spring 102 and the first contact member 82 are disposed at the −Y-directional end of the first rotating shaft 37. In addition, both the second torsion spring 112 and the second contact member 104 are disposed at the +Y-directional end of the first rotating shaft 37. However, no mechanisms for moving the first rotating shaft 37 are disposed at the center of the first rotating shaft 37 in the +Y direction. Thus, it is possible to dispose other functional components around the center.

In the transport section 30, the door 42 can be opened in a cross direction from the closed location, the cross direction intersecting both the first rotating shaft 37 and the third rotating shaft 41. Because the first contact member 82 disposed at the −Y-directional end of the second rotating shaft 39 is closer to the door 42 than the second contact member 104 disposed at the +Y-directional end is, the length of the stroke in which the first contact member 82 moves in the cross direction becomes shorter. Because the second contact member 104 disposed at the +Y-directional end of the second rotating shaft 39 is further from the door 42 than the first contact member 82 disposed at the −Y-directional end is, the length of the stroke in which the first contact member 82 moves in the cross direction becomes longer. On the −Y-directional side, however, the first contact member 82 moves in the ±Y directions in addition to the cross direction. In this case, the stroke length of the first contact member 82 in the ±Y directions can be set to be longer than the stroke length in the cross direction. This can secure a long stroke length of the first contact member 82 upon the opening of the door 42, compared to a configuration in which a first contact member moves only in the cross direction. Therefore, it is possible to sufficiently move the −Y-directional end of the first rotating shaft 37, the stroke length of which may have been difficult to sufficiently secure. Sufficiently securing the stroke length of the first contact member 82 in this manner can equally move both the first contact member 82 and the second contact member 104 from the initial period in which the door 42 is opened, thereby uniformly releasing the nipping state of the first rollers 36 and the second rollers 38 at the ±Y-directional ends.

In the transport section 30, the ±Y-directional ends of the first rotating shaft 37 are integrated with each other. In addition, the first rotating shaft 37 moves, with the +Y-directional end kept in contact with the second torsion spring 112 and the −Y-directional end kept in contact with the first torsion spring 102. This can stably maintain the attitude of the first rotating shaft 37, compared to a configuration in which a plurality of first rotating shafts are arranged side by side in the +Y direction.

In the transport section 30, the contact member 56 in the door 42 makes contact with the second contact member 104, thereby rotating the second contact member 104 around the fourth rotating shaft 105 to move the first rotating shaft 37. In this case, the fourth rotating shaft 105 is positioned, in an extending direction of the third rotating shaft 41, between the contact point C and the point at which the first rotating shaft 37 is in contact with the second contact member 104, the fourth rotating shaft 105 acting as the fulcrum point of the second contact member 104, the contact point C acting as the fulcrum point of the second contact member 104, the first rotating shaft 37 acting as the working point of the second contact member 104. This configuration can suppress the second contact member 104 from excessively moving. In addition, the rotational motion of the second contact member 104 causes the first rotating shaft 37 to move, successfully releasing the nipping state of the first rollers 36 and the second rollers 38 within a small space.

In the transport section 30, when returned to their previous shape after the compression, the pressing springs 114 apply pressing forces to the corresponding first rollers 36. In this case, the pressing springs 114 press the first rollers 36 against the second rollers 38, thereby successfully reserving a sufficient nipping pressure therebetween. This nipping pressure becomes higher at the center than at the ±Y-directional ends. This configuration can reduce the risk of the paper sheet P being torn even if a user attempts to remove a paper sheet P jamming around the nip point from the printer 10 by strongly pulling the center of the paper sheet P in the +Y direction. This is because only light loads are placed on the ±Y-directional sides of the paper sheet P. Consequently, it is possible to remove the paper sheet P without its portion left around the nip point when a paper sheet P jams between the first rollers 36 and the second rollers 38.

In the transport section 30, all of the first rollers 36 and the second rollers 38 are continuously supported by the support unit 70 in the main body 12, independently of the state of the first and second rollers. Thus, even when entering the nipping state multiple times, the positional relationship between the first rollers 36 and the second rollers 38 is less likely to change, compared to a configuration in which first rollers are supported by a main body and second rollers are supported by a door. Therefore, the positions of the second rollers 38 are maintained preciously, regardless of whether the door 42 is open or closed.

In the transport section 30, when releasing the nipping state, only the first rollers 36, which act as driven rollers, move. Thus, a mechanism for transferring the power from the motor 61 does not have to move. Therefore, the transport section 30 can be implemented with a simple mechanism.

In the transport section 30, at least a portion of the double-side-recording route TM is formed in the door 42. In this case, a user can remove a paper sheet P from the double-side-recording route TM or maintain the double-side-recording route TM via the aperture 12A by opening the door 42. In short, it is possible to easily remove a paper sheet P from the double-side-recording route TM or to easily maintain the double-side-recording route TM, compared to a configuration in which an entire double-side-recording route is formed in a main body.

In the transport section 30, the second rollers 38 are disposed inside the looped transport route TR when information is recorded on both surfaces of a paper sheet P. Thus, the surface of the paper sheet P on which information has already been recorded makes contact with the second rollers 38. In this case, since each second roller 38 is a toothed roller, only portions of the circumferential surfaces of the second rollers 38 make contact with a paper sheet P, as opposed to a configuration in which the entire circumferential surface of each second roller makes contact with a paper sheet P. This can suppress some of the ink Q that has adhered to the first surface of the paper sheet P from being transferred to the circumferential surfaces of the second rollers 38.

It should be noted that functions and effects of the above printer 10 are substantially the same as the foregoing functions and effects of the transport section 30.

According to an embodiment of the present disclosure, the transport section 30 and the printer 10 may have configurations as described above; however, those configurations may be partly modified, omitted, or replaced within the scope of the present disclosure of this application.

A medium on which information is to be recorded by the printer 10 is not limited to a paper sheet P; alternately, the medium may be a film. A recording section in the printer 10 is not limited to the line head 28; alternatively, the recording section may be a serial head that reciprocates across the width of a paper sheet P. The height directions of the printer 10 may intersect the vertical directions.

In the printer 10, the support unit 70 may include only one of the pair of first contact member 82 and first torsion spring 102 and the pair of second contact member 104 and second torsion spring 112. In this case, the transport section 30 may move the entire first rotating shaft 37 by displacing only one of the ±Y-directional ends of the first rotating shaft 37. In addition, a first contact section (first contact member 82) may be integrated with a first moving section (first torsion spring 102); likewise, a second contact section (second contact member 104) may be implemented with a second moving section (second torsion spring 112).

The printer 10 may include a rotary member, instead of the first contact member 82 and the conversion member 94. Furthermore, the first rotating shaft 37 may include two independent components: the first component that makes contact with the first torsion spring 102; and the second component that makes contact with the second torsion spring 112. In short, the first rotating shaft 37 may include two rotary shafts arranged side by side in the +Y direction. Moreover, the fourth rotating shaft 105 may be positioned outside the area, in the +Z direction, between the first rotating shaft 37 and the contact point C.

In the printer 10, the support unit 70 does not necessarily have to include the pressing springs 114. In addition, the first rotating shaft 37 may be warped so that the ±Y-directional ends thereof are positioned closer to the second roller 38 than the center thereof is or may have a linear shape. The second rotating shaft 39 may be rotatably supported by the main body 12 or the door 42. Each first roller 36 may act as a drive roller that is movable in the ±X directions, for example, via one or more planet gears.

If the printer 10 does not have to record information on both surfaces of a paper sheet P, neither the looped transport route TR nor the switchback route TB may be provided therein. In addition, the entire double-side-recording route TM may be formed in the door 42. Each second roller 38 may be not only a toothed roller but also any other roller, such as a roller having a circular cross-section.

What is claimed is:

1. A medium transport apparatus comprising:

a first roller that transports a medium;

a second roller that nips the medium together with the first roller;

a first rotating shaft that rotatably supports the first roller;

a second rotating shaft that rotatably supports the second roller;

a support mechanism that supports the first rotating shaft and the second rotating shaft;

a main body that supports the support mechanism;

a door that opens and closes with respect to the main body and the support mechanism; and a third rotating shaft that allows the door to be rotated between a closed location and an open location, the third rotating shaft extending along a direction intersecting the first rotating shaft, the closed location being a location of the door closed, the open location being a location of the door open, wherein when the door is rotated from the closed location to the open location, the support mechanism moves the first rotating shaft from a nip point at which the first roller and the second roller nip the medium and an escaped position at which the first roller escapes from the second roller, the escaped point being further from the first roller positioned at the nip point than the nip point, and wherein the support mechanism comprises:

a first contact section configured to make contact with the door at a first end and being configured to move in an axial direction along the first rotating shaft, a first moving section that moves a first end of the first rotating shaft by receiving a force generated by contact between the first contact section and the door and applying a biasing force to the first end of the first rotating shaft.

2. The medium transport apparatus according to claim 1, wherein the support mechanism further includes a second contact section configured to make contact with the door at a second end of the first rotating shaft in the axial direction, and a second moving section that moves the second end of the first rotating shaft by receiving a force generated by contact between the second contact section and the door.

3. The medium transport apparatus according to claim 2, wherein the third rotating shaft is positioned adjacent to the first end in the axial direction along the first rotating shaft, the first contact section moves in the axial direction along the first rotating shaft by making contact with the door, and the second contact section moves in a cross direction by making contact with the door, the cross direction intersecting both the first rotating shaft and the third rotating shaft.

4. The medium transport apparatus according to claim 2, wherein the first rotating shaft includes a first section that makes contact with the first moving section and a second section that makes contact with the second moving section, the first section being integrated with the second section.

5. The medium transport apparatus according to claim 1, wherein the support mechanism includes a pressing spring that presses the first roller against the second roller.

6. The medium transport apparatus according to claim 5, wherein the support mechanism supports the first rotating shaft at locations outside the pressing spring in the axial direction along the first rotating shaft, and the first rotating shaft is warped so that a center of the first rotating shaft in the axial direction is closer to the second roller than the first and second ends of the first rotating shaft in the axial direction are.

7. The medium transport apparatus according to claim 1, wherein the main body or the support mechanism rotatably supports the second rotating shaft.

8. The medium transport apparatus according to claim 1, wherein when the door is rotated from the closed location to the open location, the support mechanism moves towards the first rotating shaft to move the first rotating shaft inwardly within the main body and from the nip point at which the first roller and the second roller nip the medium and the escaped position at which the first roller escapes from the second roller.

9. A medium transport apparatus comprising:

a first roller that transports a medium;

a second roller that nips the medium together with the first roller;

a first rotating shaft that rotatably supports the first roller;

a second rotating shaft that rotatably supports the second roller;

a support mechanism that supports the first rotating shaft and the second rotating shaft;

a main body that supports the support mechanism;

a door that opens and closes with respect to the main body and the support mechanism; and a third rotating shaft that allows the door to be rotated between a closed location and an open location, the third rotating shaft extending along a direction intersecting the first rotating shaft, the closed location being a location of the door closed, the open location being a location of the door open, wherein when the door is rotated from the closed location to the open location, the support mechanism moves the first rotating shaft from a nip point at which the first roller and the second roller nip the medium and an escaped position at which the first roller escapes from the second roller, the escaped point being further from the first roller positioned at the nip point than the nip point, the support mechanism includes a rotary member that moves the first rotating shaft by rotating around a fourth rotating shaft, the door has a contact section that makes contact with the rotary member at a contact point, and the fourth rotating shaft is positioned between the first rotating shaft and the contact point in a direction along the third rotating shaft, as viewed from the axial direction along the first rotating shaft.

10. A medium transport apparat comprising:

a first roller that transports a medium;

a second roller that nips the medium together with the first roller;

a first rotating shaft that rotatably supports the first roller;

a second rotating shaft that rotatably supports the second roller;

a support mechanism that supports the first rotating shaft and the second rotating shaft;

a main body that supports the support mechanism;

a door that opens and closes with respect to the main body and the support mechanism;

a third rotating shaft that allows the door to be rotated between a closed location and an open location, the third rotating shaft extending along a direction intersecting the first rotating shaft, the closed location being a location of the door closed, the open location being a location of the door open;

a drive source;

a looped transport route along which the medium is transported;

a switchback route coupled to the looped transport route, the switchback route by which the medium transported from the looped transport route is inverted and from which the inverted medium is returned to the looped transport route, wherein the looped transport route includes a double-side-recording route that has an infeed route via which the medium is fed to the switchback route and an ejection route via which the medium is ejected from the switchback route, and a supply route along which the medium is supplied from a meeting point at which the ejection route is merged with the supply route to a branch point at which the infeed route blanches off from the supply route; and a recording section that records information on the medium, the recording section being disposed in the main body so as to face the supply route, wherein when the door is rotated from the closed location to the open location, the support mechanism moves the first rotating shaft from a nip point which the first roller and the second roller nip the medium and an escaped position at which the first roller escapes the second roller, the escaped point being further from the first roller positioned at the nip point than the nip point, the second roller is a drive roller rotated by drive power generated by the drive source, the first roller is a driven roller that rotates together with rotation of the second roller both the first roller and the recording section are disposed outside the looped transport route, the second roller is disposed inside the looped transport route, and at least a portion of the double-side-recording route is disposed in the door.

11. The medium transport apparatus according to claim 10, wherein the recording section records the information on the medium by discharging liquid onto the medium, and the second roller is a toothed roller having a circumferential surface on which a plurality of teeth are formed.

* * * * *